US010147344B2

(12) United States Patent
Kuo et al.

(10) Patent No.: US 10,147,344 B2
(45) Date of Patent: Dec. 4, 2018

(54) DISPLAY DEVICE AND ELECTRONIC PAPER DISPLAY DEVICE

(71) Applicant: E Ink Holdings Inc., Hsinchu (TW)

(72) Inventors: Wen-Yu Kuo, Hsinchu (TW); Hsiao-Tung Chu, Hsinchu (TW); Po-Chun Chuang, Hsinchu (TW); Pei-Lin Huang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 15/786,585

(22) Filed: Oct. 17, 2017

(65) Prior Publication Data

US 2018/0158388 A1 Jun. 7, 2018

(30) Foreign Application Priority Data

Dec. 1, 2016 (CN) ..... 2016 1 1092199

(51) Int. Cl.

*G09G 3/20* (2006.01)
*G09G 3/00* (2006.01)
*G09G 5/02* (2006.01)

(52) U.S. Cl.

CPC ..... *G09G 3/20* (2013.01); *G09G 3/003* (2013.01); *G09G 5/02* (2013.01); *G09G 2300/0426* (2013.01); *G09G 2300/0439* (2013.01); *G09G 2310/0272* (2013.01); *G09G 2380/14* (2013.01)

(58) Field of Classification Search

CPC ..... G09G 3/344; G09G 3/20; G09G 5/02; G09G 3/003; G09G 2380/14; G09G 2300/0439; G09G 2310/0272; G09G 2300/0426

See application file for complete search history.

(56) References Cited

U.S. PATENT DOCUMENTS

| | | | | |
|---|---|---|---|---|
| 6,859,195 | B2 | 2/2005 | Kodate | |
| 8,519,908 | B2 | 8/2013 | Lee et al. | |
| 2006/0145981 | A1 | 7/2006 | Lee et al. | |
| 2006/0290617 | A1 * | 12/2006 | Miyazawa | G09G 3/325 345/76 |
| 2008/0136773 | A1 | 6/2008 | Kim et al. | |

(Continued)

FOREIGN PATENT DOCUMENTS

| | | | |
|---|---|---|---|
| JP | 2008242383 | A | 10/2008 |
| JP | 2008268853 | A | 11/2008 |

(Continued)

OTHER PUBLICATIONS

Corresponding Taiwanese office action dated Mar. 6, 2017.

*Primary Examiner* — Amit Chatly
(74) *Attorney, Agent, or Firm* — CKC & Partners Co., Ltd.

(57) ABSTRACT

A display device includes a first display unit, a first selecting switch, a first block switch, a first selecting gate line, a second display unit, a second selecting switch, a second block switch, a second selecting gate line, and a block gate line. The first selecting gate line is configured to provide a first selecting gate signal to a control end of the first selecting switch. The second selecting gate line is configured to provide a second selecting gate signal to a control end of the second selecting switch. The block gate line is configured to provide a block gate signal to a control end of the first block switch and a control end of the second block switch.

10 Claims, 9 Drawing Sheets

(56) References Cited

U.S. PATENT DOCUMENTS

| | | | | |
|---|---|---|---|---|
| 2011/0096053 | A1* | 4/2011 | Yamazaki | G09G 3/344<br>345/211 |
| 2011/0170031 | A1* | 7/2011 | Son | G09G 3/3659<br>349/46 |
| 2011/0181585 | A1* | 7/2011 | Ozawa | G09G 3/3648<br>345/213 |
| 2011/0234605 | A1 | 9/2011 | Smith et al. | |

FOREIGN PATENT DOCUMENTS

| | | |
|---|---|---|
| TW | I408641 B | 9/2013 |
| TW | I430227 B | 3/2014 |
| TW | I437531 B | 5/2014 |

* cited by examiner

DISPLAY DEVICE AND ELECTRONIC PAPER DISPLAY DEVICE

RELATED ART

This application claims priority to Chinese Application Serial Number 201611092199.0, filed Dec. 1, 2016, which is herein incorporated by reference.

BACKGROUND

Field of Invention

The present disclosure relates to an electronic device. More particularly, the present disclosure relates to a display device and an electronic paper device.

Description of Related Art

With advances in technology, display devices are widely used in ours' daily lives.

A typical display device may include gate lines, data lines, switches, and pixel electrodes. The gate lines are configured to transmit gate signals to turn on switches, so as to allow the data lines to provide data voltages to the pixel electrodes. However, capacitors may be generated between the gate lines and the pixel electrodes, and it will affect the transmission of the gate signals. Thus, dispositions of the gate lines and the pixel electrodes are an important area of research in this field.

SUMMARY

One aspect of the present disclosure is related to a display device. In accordance with one embodiment of the present disclosure, the display device includes a first display unit, a first selecting switch, a first block switch, a first selecting gate line, a second display unit, a second selecting switch, a second block switch, a second selecting gate line, and a block gate line. The first display unit includes a first pixel electrode. The first selecting switch is electrically connected to the first pixel electrode. The first block switch is electrically connected to the first selecting switch and the first pixel electrode. The first selecting gate line is configured to provide a first selecting gate signal to a control end of the first selecting switch to turn on or turn off the first selecting switch. The second display unit includes a second pixel electrode. The second pixel electrode is adjacent to the first pixel electrode. The second selecting switch is electrically connected to the second pixel electrode. The second block switch is electrically connected to the second selecting switch and the second pixel electrode. The second selecting gate line is configured to provide a second selecting gate signal to a control end of the second selecting switch to turn on or turn off the second selecting switch, wherein when the first selecting switch turns on, the second selecting switch turns off, and when the second selecting switch turns on, the first selecting switch turns off. The block gate line configured to provide a block gate signal to a control end of the first block switch and a control end of the second block switch to concurrently turn on or turn off the first block switch and the second block switch.

In accordance with one embodiment of the present disclosure, an electrode pattern of the first pixel electrode and an electrode pattern of the second pixel electrode are symmetric to each other with respect to the block gate line, substantially.

In accordance with one embodiment of the present disclosure, the first pixel electrode and the second pixel electrode are substantially disposed at two opposite sides of the first selecting gate line, the second selecting gate line, and/or the block gate line.

In accordance with one embodiment of the present disclosure, the display device includes a third pixel electrode, a third selecting switch, and a third block switch. The third pixel electrode is adjacent to the first pixel electrode. The third selecting switch is electrically connected to the third pixel electrode, wherein a control end of the third selecting switch is configured to receive the first selecting gate signal from the first selecting gate line, so as to make the first selecting switch and the third selecting switch turn on or turn off concurrently. The third block switch is electrically connected to the third selecting switch and the third pixel electrode, wherein a control end of the third block switch is configured to receive the block gate signal from the block gate line, so as to make the first block switch, the second block switch, and the third block switch turn on or turn off concurrently. An electrode pattern of the first pixel electrode and an electrode pattern of the third pixel electrode are substantially symmetric to each other.

In accordance with one embodiment of the present disclosure, the display device further includes a first data line configured to provide a first data voltage to the first pixel electrode and a second data line configured to provide a second data voltage to the third pixel electrode. The first pixel electrode and the third pixel electrode are substantially disposed between the first data line and the second data line.

Another aspect of the present disclosure is related to an electronic paper display device. In accordance with one embodiment of the present disclosure, the electronic paper includes an electronic ink layer, a common electrode, a first pixel electrode, a first selecting switch, a first block switch, a first selecting gate line, a second pixel electrode, a second selecting switch, a second block switch, a second selecting gate line, and a block gate line. The common electrode is disposed at a first side of the electronic ink layer. The first pixel electrode is disposed at a second side of the electronic ink layer. The first selecting switch is electrically connected to the first pixel electrode. The first block switch is electrically connected to the first selecting switch and the first pixel electrode. The first selecting gate line is configured to provide a first selecting gate signal to a control end of the first selecting switch to turn on or turn off the first selecting switch. The second pixel electrode is adjacent to the first pixel electrode and disposed at the second side of the electronic ink layer. The second selecting switch is electrically connected to the second pixel electrode. The second block switch is electrically connected to the second selecting switch and the second pixel electrode. The second selecting gate line is configured to provide a second selecting gate signal to a control end of the second selecting switch. The block gate line is configured to provide a block gate signal to a control end of the first block switch and a control end of the second block switch to concurrently turn on or turn off the first block switch and the second block switch.

In accordance with one embodiment of the present disclosure, an electrode pattern of the first pixel electrode and an electrode pattern of the second pixel electrode are symmetric to each other with respect to the block gate line, substantially.

In accordance with one embodiment of the present disclosure, the common electrode includes a first portion corresponding to the first pixel electrode and a second portion corresponding to the second pixel electrode. An electrode pattern of the first portion of the common electrode and an electrode pattern of the second portion of the common electrode are symmetric to each other with respect to the block gate line, substantially.

In accordance with one embodiment of the present disclosure, the first pixel electrode and the second pixel electrode are substantially disposed at two opposite sides of the first selecting gate line, the second selecting gate line, and/or the block gate line.

In accordance with one embodiment of the present disclosure, the display device includes a third pixel electrode, a third selecting switch, and a third block switch. The third pixel electrode is adjacent to the first pixel electrode. The third selecting switch is electrically connected to the third pixel electrode, wherein a control end of the third selecting switch is configured to receive the first selecting gate signal from the first selecting gate line, so as to make the first selecting switch and the third selecting switch turn on or turn off concurrently. The third block switch is electrically connected to the third selecting switch and the third pixel electrode, wherein a control end of the third block switch is configured to receive the block gate signal from the block gate line, so as to make the first block switch, the second block switch, and the third block switch turn on or turn off concurrently. An electrode pattern of the first pixel electrode and an electrode pattern of the third pixel electrode are substantially symmetric to each other.

Through utilizing one embodiment described above, the amount of the gate lines can be decreased, so that the space for disposing the pixel electrodes can be increased.

DETAILED DESCRIPTION

Figure 1:
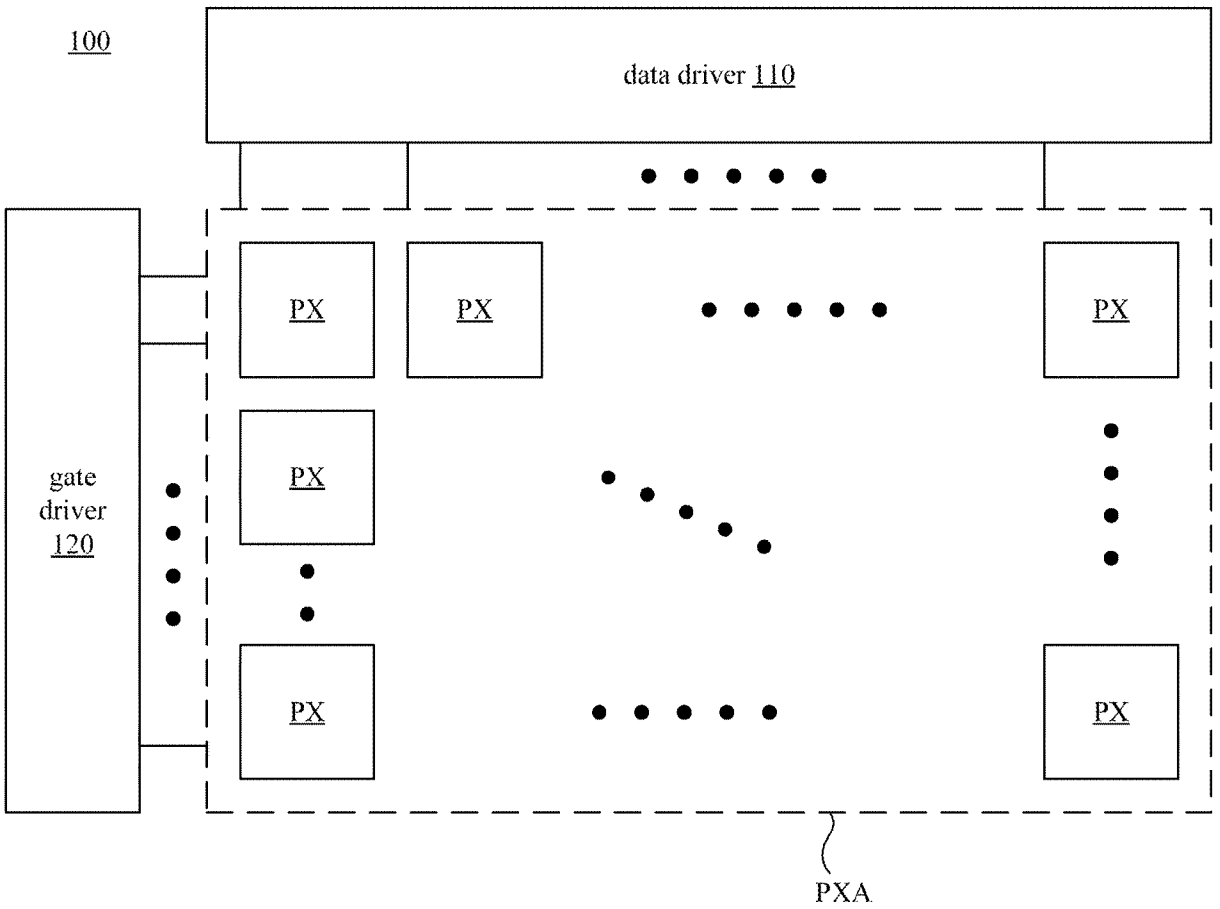
FIG. 1 illustrates a schematic diagram of a display device according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "connected" or "electrically connected" to another element, it can be directly connected to the other element or intervening elements may be present. In contrast, when an element is referred to as being "directly connected" to another element, there are no intervening elements present. Moreover, "electrically connect" or "connect" can further refer to the interoperation or interaction between two or more elements.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the present disclosure.

It will be understood that, in the description herein and throughout the claims that follow, the term "substantially" is used in association with values that may vary slightly, in which such minor errors do not change the properties and the characteristics relevant to the values.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

Reference is made to FIG. 1. FIG. 1 illustrates a schematic diagram of a display device 100 according to one embodiment of the present disclosure. In one embodiment, the display device 100 may be an electronic paper display, but the present disclosure is not limited in this regard.

In this embodiment, the display device 100 includes a data driver 110, a gate driver 120, and a pixel array PXA. In this embodiment, the pixel array PXA includes a plurality of pixel units PX, and the pixel units PX are arranged in an array.

In this embodiment, the gate driver 120 is configured to provide gate signals to the pixel array PXA, to turn on switches of the pixel units PX row by row. The data driver 110 is configured to provide data voltages to the pixel array PXA, to make pixel electrodes of the pixel units PX charge or discharge according to the data voltages.

Figure 2:
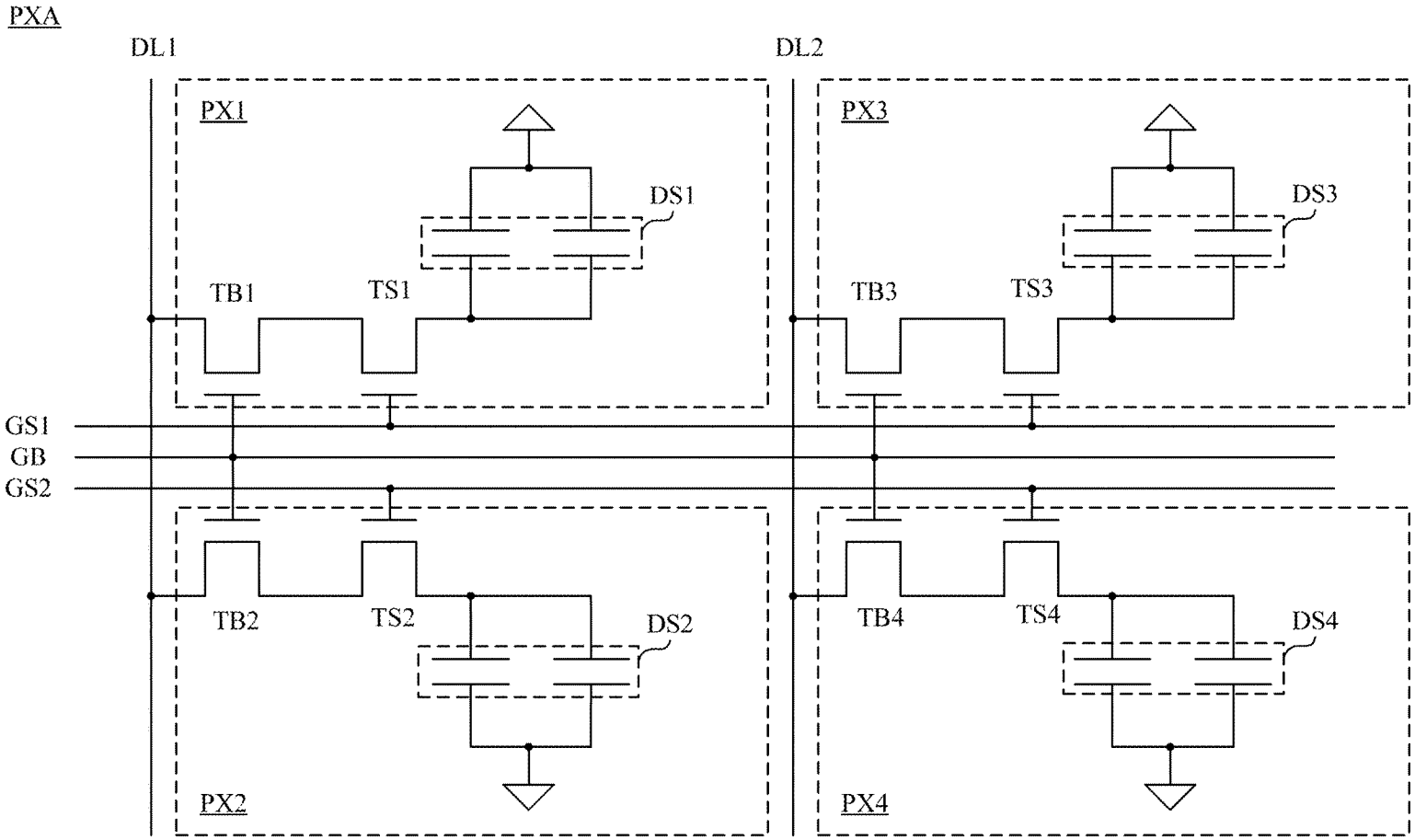
FIG. 2 illustrates a schematic diagram of a pixel array according to one embodiment of the present disclosure.

Reference is made to FIG. 2. FIG. 2 illustrates a schematic diagram of the pixel array PXA according to one embodiment of the present disclosure.

In this embodiment, the pixel array PXA includes pixel units PX1-PX4, in which each of the pixel units PX1-PX4 may be one of the pixel units PX described above. The gate driver 120 may provide gate signals to the pixel units PX1-PX4 via a first selecting gate line GS1, a second selecting gate line GS2, and a block gate line GB. The data driver 110 may provide data voltages to the pixel units PX1-PX4 via a first data line DL1 and a second data line DL2. It should be noted that the amounts of the gate lines, the data lines, and the pixel units are for illustrative purposes, and other amounts of the gate lines, the data lines, and the pixel units are within the contemplated scope of the present disclosure. For example, in some embodiments, the pixel units PX3-PX4 and the second data line DL2 may be omitted.

In one embodiment, the first selecting gate line GS1, the second selecting gate line GS2, and the block gate line GB are parallel to each other. In one embodiment, a distance between the first selecting gate line GS1 and the block gate line GB is equal to a distance between the second selecting gate line GS2 and the block gate line GB. In one embodiment, the first data line DS1 and the second data line DS2 are parallel to each other.

In one embodiment, the pixel unit PX1 includes a selecting switch TS1, a block switch TB1, and a display unit DS1; the pixel unit PX2 includes a selecting switch TS2, a block switch TB2 and a display unit DS2; the pixel unit PX3 includes a selecting switch TS3, a block switch TB3, and a display unit DS3; and the pixel unit PX4 includes a selecting switch TS4, a block switch TB4, and a display unit DS4.

In one embodiment, the selecting switch TS1 and the block switch TB1 are electrically connected, and the selecting switch TS1 and the block switch TB1 are electrically connected between the first data line DL1 and the display unit DS1. The selecting switch TS2 and the block switch TB2 are electrically connected, and the selecting switch TS2 and the block switch TB2 are electrically connected between the first data line DL1 and the display unit DS2. The selecting switch TS3 and the block switch TB3 are electrically connected, and the selecting switch TS3 and the block switch TB3 are electrically connected between the second data line DL2 and the display unit DS3. The selecting switch TS4 and the block switch TB4 are electrically connected, and the selecting switch TS4 and the block switch TB4 are electrically connected between the second data line DL2 and the display unit DS4.

Figure 3:
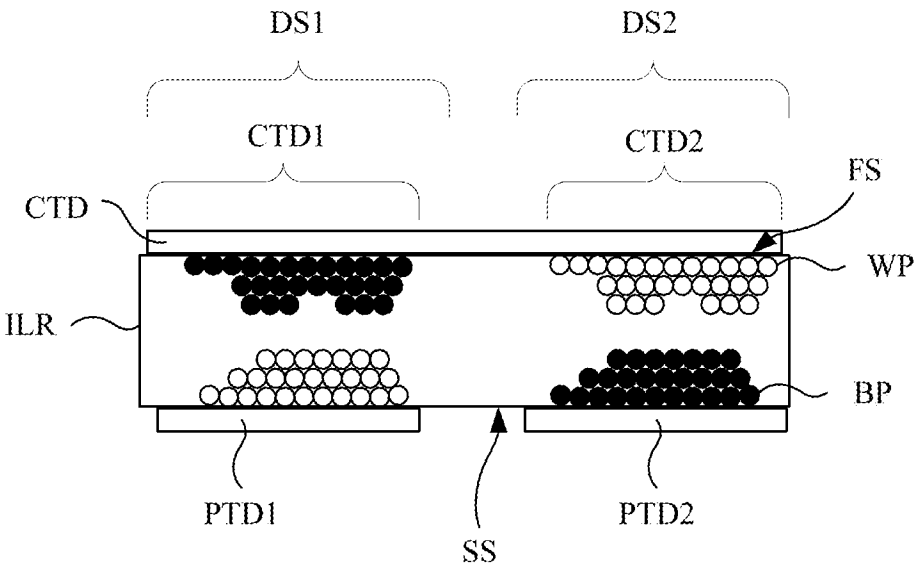
FIG. 3 illustrates a schematic diagram of a common electrode, pixel electrodes, and an electronic ink layer according to one embodiment of the present disclosure.

Reference is made to FIG. 3. In one embodiment, each of the display units DS1-DS4 may include a portion of a common electrode CTD, a pixel electrode, and a portion of an electronic ink layer ILR. For example, in one embodiment, the display unit DS1 includes a pixel electrode PTD1, a first portion CTD1 of the common electrode CTD corresponding to the pixel electrode PTD1, and a portion of the electronic ink layer ILR corresponding to the pixel electrode PTD1; the display unit DS2 includes a pixel electrode PTD2, a second portion CTD2 of the common electrode CTD corresponding to the pixel electrode PTD2, and a portion of the electronic ink layer ILR corresponding to the pixel electrode PTD2.

In one embodiment, the common electrode CTD is disposed at a first side FS of the electronic ink layer ILR, and the pixel electrodes PTD1, PTD2 are disposed at a second side SS of the electronic ink layer ILR. The pixel electrodes PTD1, PTD2 can generate electrical fields with the first portion CTD1 and the second portion CTD2 of the common electrode CTD respectively, so as to separately drive the dark particles BP and the white particles WP inside the electronic ink layer ILR toward the first side FS of the electronic ink layer ILR and the second side SS of the electronic ink layer ILR, to allow the display units DS1-DS4 to display black colors or white colors. It should be noted that the structure of the electronic ink layer ILR is for illustrative purpose, and another structure of the electronic ink layer ILR is within the contemplated scope of the present disclosure.

Reference is made back to FIG. 2. In one embodiment, the first selecting gate line GS1 is electrically connected to control ends of the selecting switches TS1, TS3, configured to provide a first selecting gate signal to the control ends of the selecting switches TS1, TS3, to concurrently turn on or turn off the selecting switches TS1, TS3. The first selecting gate line GS2 is electrically connected to control ends of the selecting switches TS2, TS4, configured to provide a second selecting gate signal to the control ends of the selecting switches TS2, TS4, to concurrently turn on or turn off the selecting switches TS2, TS4. The block gate line GB is electrically connected to control ends of the block switches TB1-TB4, configured to provide a block gate signal to the control ends of the block switches TB1-TB4, to concurrently turn on or turn off the block switches TB1-TB4.

In other words, in one embodiment, the block gate signal can be used to concurrently turn on block switches of multiple rows of the display units, and each of the first selecting gate signal and the second selecting gate signal can be used to turn on selecting switches of one row of the display units.

In one embodiment, a period of the block gate signal is longer than periods of the first selecting gate signal and the second selecting gate signal. For example, the period of the block gate signal may be 5 milliseconds, and the periods of the first selecting gate signal and the second selecting gate signal may be 1.25 milliseconds or 80 microseconds.

In one embodiment, during a first period, when the block gate signal concurrently turns on block switches TB1-TB4, the first selecting gate signal concurrently turns on the selecting switches TS1, TS3, and the second selecting gate signal concurrently turns off the selecting switches TS2, TS4, the first data line DL1 provide a first data voltage to display unit DS1 via the turned on selecting switch TS1 and the turned on block switches TB1, so as to make the pixel electrode in the display unit DS1 charge or discharge accordingly, and the second data line DL2 provide a third data voltage to display unit DS3 via the turned on selecting switch TS3 and the turned on block switches TB3, so as to make the pixel electrode in the display unit DS3 charge or discharge accordingly.

During a second period after the first period, when the block gate signal concurrently turns on block switches TB1-TB4, the first selecting gate signal concurrently turns off the selecting switches TS1, TS3, and the second selecting gate signal concurrently turns on the selecting switches TS2, TS4, the first data line DL1 provide a second data voltage to display unit DS2 via the turned on selecting switch TS2 and the turned on block switches TB2, so as to make the pixel electrode in the display unit DS2 charge or discharge accordingly, and the second data line DL2 provide a fourth data voltage to display unit DS4 via the turned on selecting switch TS4 and the turned on block switches TB4, so as to make the pixel electrode in the display unit DS4 charge or discharge accordingly.

Through the configuration of the selecting switches TS1-TS4 and the block switches TB1-TB4, inaccurately charging or discharging the display units DS1-DS4 can be avoided.

In one embodiment, the pixel units PX1, PX2 are symmetric to each other, substantially. In one embodiment, the pixel units PX1, PX2 are symmetric to each other with respect to the block gate line GB, substantially. More specifically, in one embodiment, the shapes and/or the structures of the selecting switch TS1, the block switch TB1, and the display unit DS1 are symmetric to the shapes and/or the structures of the selecting switch TS2, the block switch TB2, and the display unit DS2 with respect to the block gate line GB, substantially. In one embodiment, the pixel units PX3, PX4 can also substantially symmetric to each other, and the symmetric relationship therebetween can be identical to or similar to the symmetric relationship between the pixel units PX1, PX2.

Through such a configuration, the pixel units PX1, PX2 can use identical block gate line GB without other wirings.

In some approaches, different pixel units correspond to different block gate lines. In such a manner, there are a large number of the block gate lines, to that the space for disposing the pixel electrodes is limited.

In one embodiment of the present disclosure, the pixel units PX1, PX2 use identical block gate line GB, so that the number of the block gate lines can be decreased, and the space for disposing the pixel electrodes can be increased. As a result, the area of the pixel electrodes can be increased, so that the uncontrollable region of the electronic ink layer ILR can be decreased, and the display quality can be increased.

Moreover, in one embodiment of the present disclosure, the pixel units PX1, PX2 are substantially symmetric to each other with respect to the block gate line GB, so that the pixel units PX1, PX2 can use identical block gate line GB without adding extra wirings.

Figure 4:
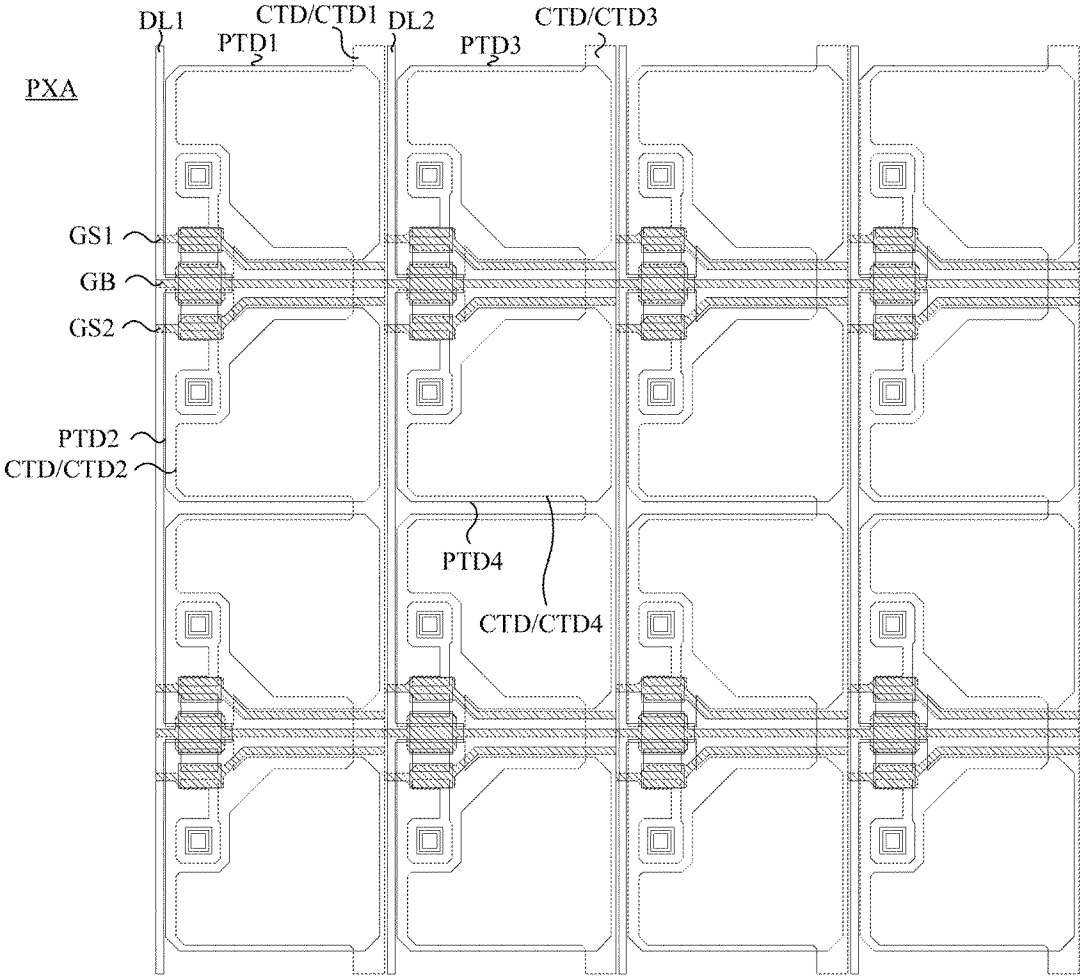
FIG. 4 illustrates a layout of a pixel array according to one embodiment of the present disclosure.

Reference is made to FIG. 4, in which FIG. 4 illustrates a layout of a pixel array PXA according to one embodiment of the present disclosure. In this embodiment, the pixel electrode PTD1 is adjacent to the pixel electrode PTD2 and the pixel electrode PTD3. The pixel electrode PTD4 is adjacent to the pixel electrode PTD2 and the pixel electrode PTD3. The pixel electrode PTD1 is diagonally opposite to the pixel electrode PTD4. The pixel electrode PTD2 is diagonally opposite to the pixel electrode PTD3.

In this embodiment, electrode patterns of the pixel electrode PTD1 and the pixel electrode PTD3 of the pixel units PX1,PX3 are respectively symmetric to electrode patterns of the pixel electrode PTD2 and the pixel electrode PTD4 of the pixel units PX2, PX4, substantially. In this embodiment, an electrode pattern of a first portion CTD1 of the common electrode CTD corresponding to the pixel electrode PTD1 is symmetric to an electrode pattern of a second portion CTD2 of the common electrode CTD corresponding to the pixel electrode PTD2. In this embodiment, an electrode pattern of a third portion CTD3 of the common electrode CTD corresponding to the pixel electrode PTD3 is symmetric to an electrode pattern of a fourth portion CTD4 of the common electrode CTD corresponding to the pixel electrode PTD4.

In this embodiment, the pixel electrode PTD1 and the pixel electrode PTD3 are substantially disposed at first sides of the first selecting gate line GS1, the second selecting gate line GS2, and/or the block gate line GB. The pixel electrode PTD4 and the pixel electrode PTD2 are substantially disposed at second sides of the first selecting gate line GS1, the second selecting gate line GS2, and/or the block gate line GB opposite to the first sides.

In this embodiment, the first portion CTD1 and the third portion CTD3 of the common electrode CTD corresponding to the pixel electrode PTD1 and the pixel electrode PTD3 are substantially disposed at first side of the first selecting gate line GS1, the second selecting gate line GS2, and/or the block gate line GB. The second portion CTD2 and the fourth portion CTD3 of the common electrode CTD corresponding to the pixel electrode PTD2 and the pixel electrode PTD4 are substantially disposed at second sides of the first selecting gate line GS1, the second selecting gate line GS2, and/or the block gate line GB opposite to the first sides.

In this embodiment, the pixel electrode PTD1, the pixel electrode PTD2, and the first portion CTD1 and the second portion CTD2 of the common electrode CTD corresponding to the pixel electrode PTD1 and the pixel electrode PTD2 are substantially disposed between the first data line DL1 and the second data line DL2.

Figure 5:
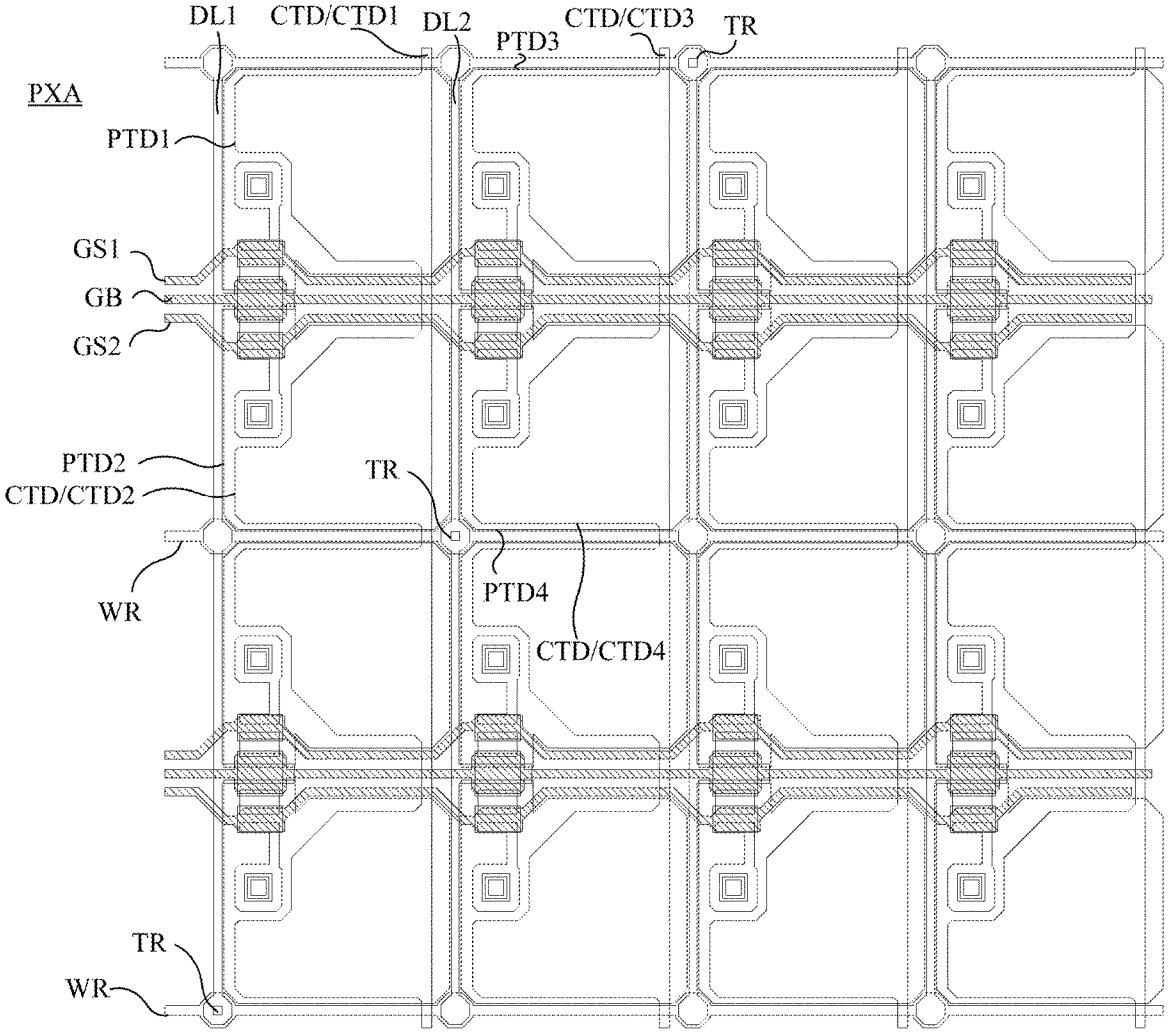
FIG. 5 illustrates a layout of a pixel array according to another embodiment of the present disclosure.

Reference is made to FIG. 5, in which FIG. 5 illustrates a layout of a pixel array PXA according to another embodiment of the present disclosure. The pixel array PXA illustrated in FIG. 5 is substantially similar to the pixel array PXA illustrated in FIG. 4, and many aspects that are similar will not be repeated herein.

In this embodiment, the display device 100 can further include connectors TR. In this embodiment, the connectors TR are configured to electrically connect different conducting layers. In this embodiment, the connectors TR can be disposed at intersections of the longitudinal data lines DL1, DL2 and the transverse conducting lines WR, configured to electrically connect the data lines DL1, DL2 and the conducting lines WR. In such a configuration, the display device 100 can have an expanded number of ways for providing the data voltages. For example, in some embodiments, different data lines (e.g., data lines DL1, DL2) can be electrically connected to an identical conducting line WR via the connectors TR, so that an identical data voltage can be provided to different data lines concurrently.

Figure 6:
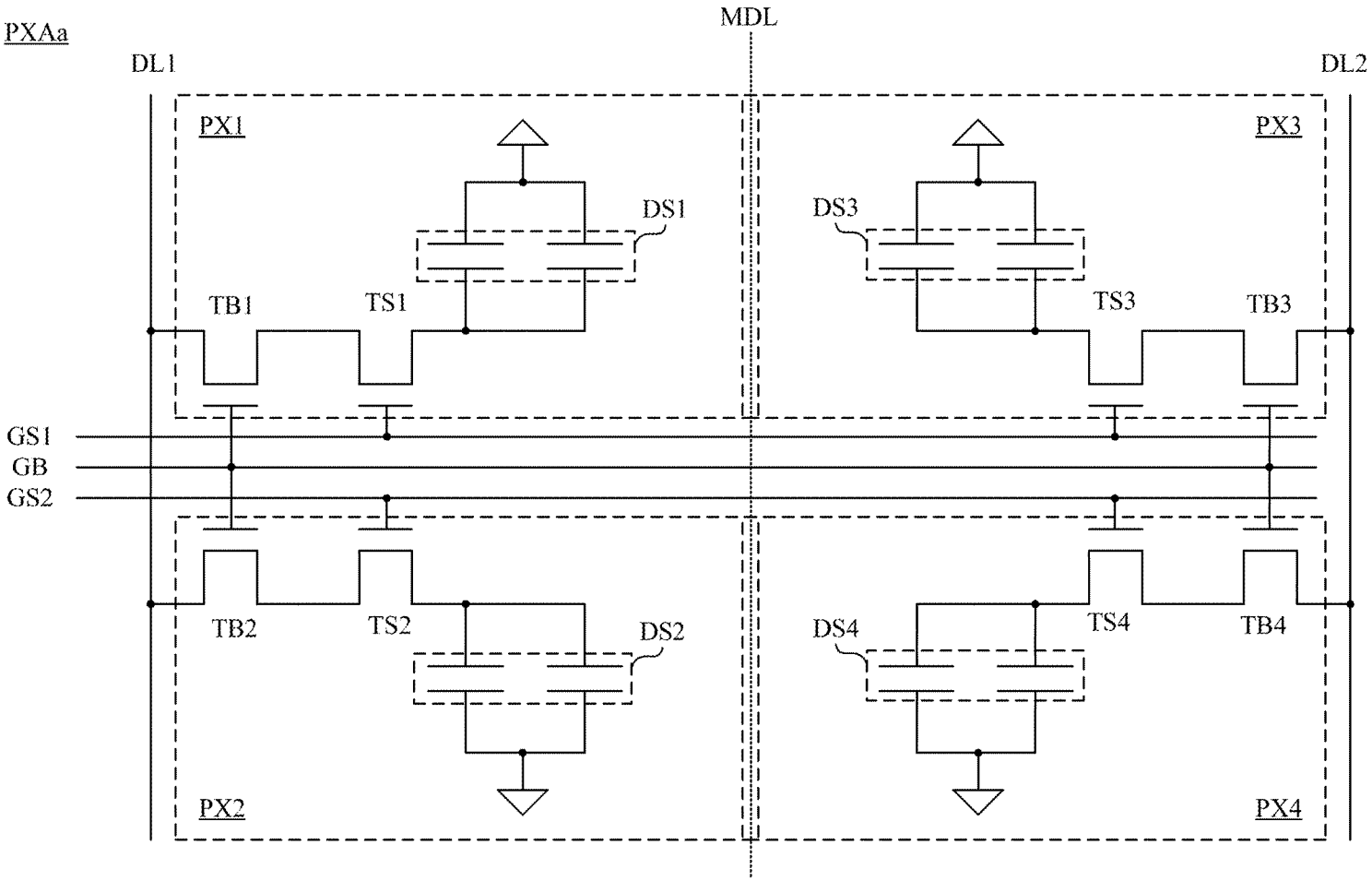
FIG. 6 illustrates a schematic diagram of a pixel array according to another embodiment of the present disclosure.

Reference is made to FIG. 6, in which FIG. 6 illustrates a schematic diagram of a pixel array PXAa according to another embodiment of the present disclosure. The pixel array PXAa illustrated in FIG. 6 is substantially similar to the pixel array PXA illustrated in FIG. 2, and many aspects that are similar will not be repeated herein.

In this embodiment, the pixel units PX1 and the pixel units PX3 are substantially symmetric to each other. In this embodiment, the pixel units PX1 and the pixel units PX3 are substantially symmetric to each other with respect to a line MDL, in which the line MDL is parallel to the first data line DL1 and the second data line DL2, and a distance between the line MDL and the first data line DL1 is substantially equal to a distance between the line MDL and the second data line DL2.

More specifically, in one embodiment, the shapes and/or the structures of the selecting switch TS1, the block switch TB1, and the display unit DS1 are symmetric to the shapes and/or the structures of the selecting switch TS3, the block switch TB3, and the display unit DS3 with respect to the line MDL, substantially. In one embodiment, the pixel units PX2, PX4 can also substantially symmetric to each other, and the symmetric relationship therebetween can be identical to or similar to the symmetric relationship between the pixel units PX1, PX3, and details in this regard will not be repeated herein.

In one embodiment, the pixel units PX1-PX4 are substantially disposed between the first data line DL1 and the second data line DL2. In one embodiment, the pixel units PX1-PX2 are substantially disposed between the first data line DL1 and the line MDL. In one embodiment, the pixel units PX3-PX4 are substantially disposed between the second data line DL2 and the line MDL.

Figure 7:
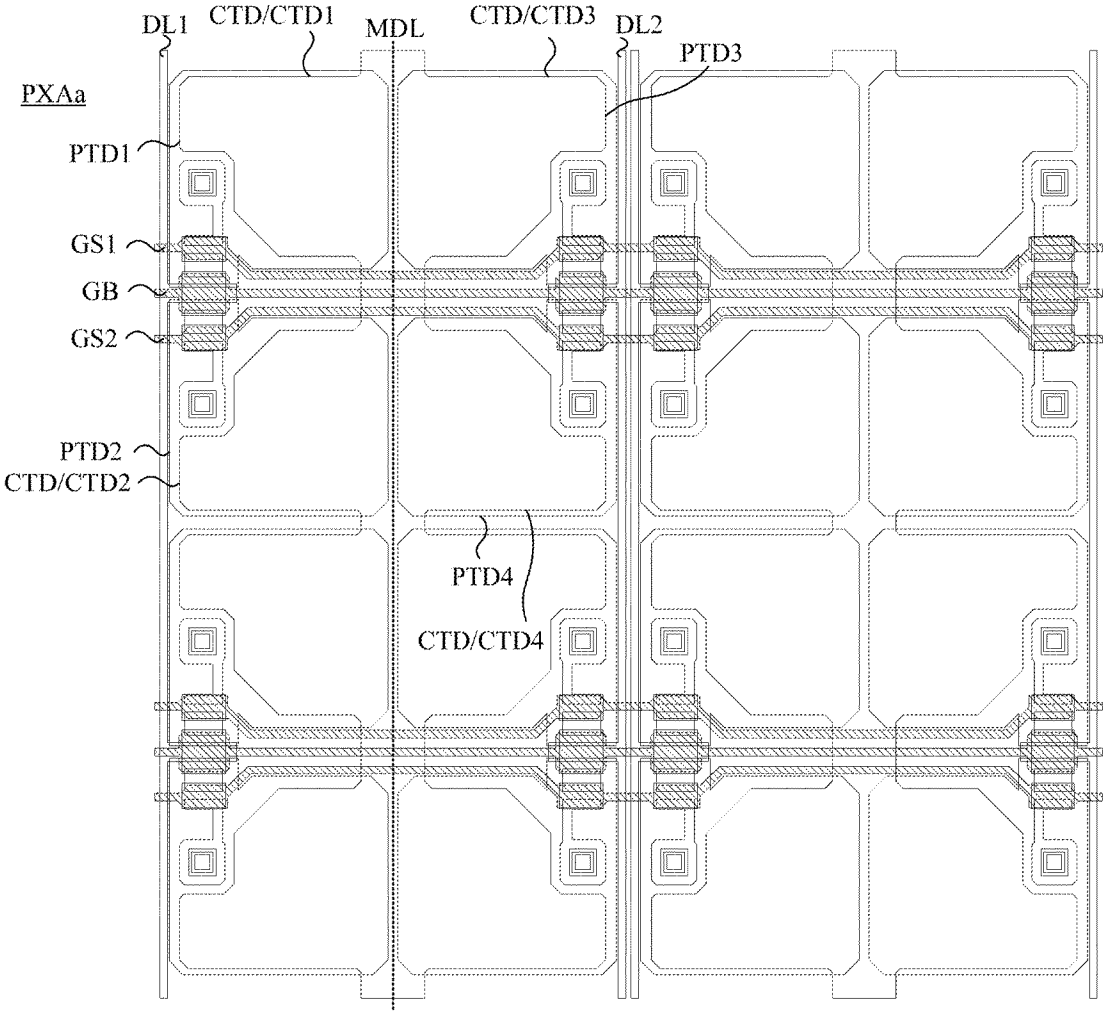
FIG. 7 illustrates a layout of a pixel array according to another embodiment of the present disclosure.

Reference is made to FIG. 7, in which FIG. 7 illustrates a layout of a pixel array PXAa according to another embodiment of the present disclosure. The pixel array PXAa illustrated in FIG. 7 is substantially similar to the pixel array PXA illustrated in FIG. 4, and many aspects that are similar will not be repeated herein.

In this embodiment, the electrode patterns of the pixel electrode PTD1 and the pixel electrode PTD2 of the pixel units PX1, PX2 are respectively symmetric to electrode patterns of the pixel electrode PTD3 and the pixel electrode PTD4 of the pixel units PX3, PX4 with respect to the line MDL, substantially. In this embodiment, the electrode pattern of the common electrode CTD is symmetric with respect to the line MDL.

In this embodiment the pixel electrodes PTD1-PTD4 and the common electrode CTD are substantially disposed between the first data line DL1 and the second data line DL2. In this embodiment, the pixel electrodes PTD1-PTD2 are substantially disposed between the first data line DL1 and the line MDL, and the pixel electrodes PTD3-PTD4 are substantially disposed between the second data line DL2 and the line MDL.

Figure 8:
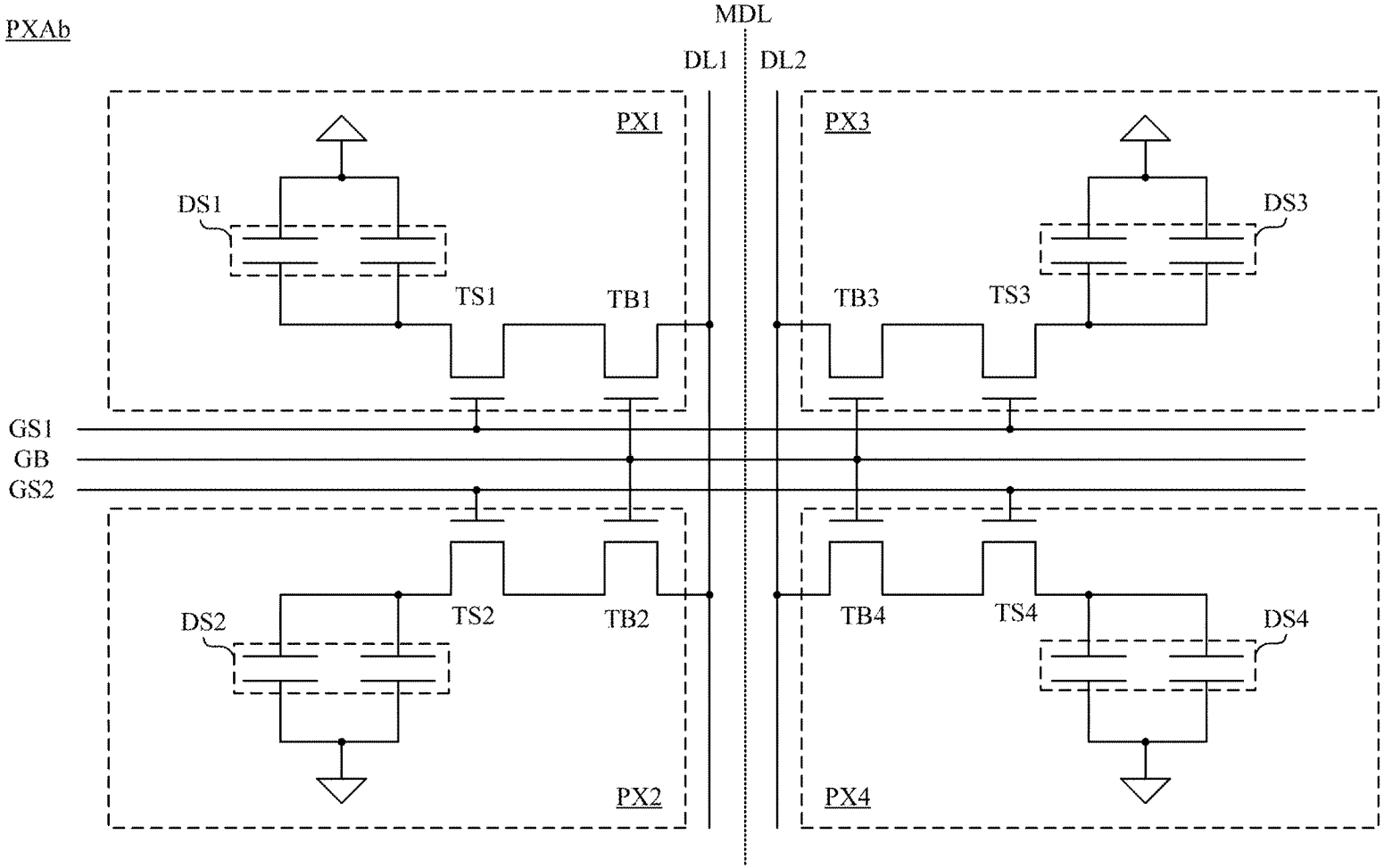
FIG. 8 illustrates a schematic diagram of a pixel array according to another embodiment of the present disclosure.

Reference is made to FIG. 8, in which FIG. 8 illustrates a schematic diagram of a pixel array PXAb according to one embodiment of the present disclosure. The pixel array PXAb illustrated in FIG. 8 is substantially similar to the pixel array PXA illustrated in FIG. 2, and many aspects that are similar will not be repeated herein.

In this embodiment, the pixel units PX1 and the pixel units PX3 are substantially symmetric to each other. In this embodiment, the pixel units PX1 and the pixel units PX3 are substantially symmetric to each other with respect to a line MDL, in which the line MDL is parallel to the first data line DL1 and the second data line DL2, and a distance between the line MDL and the first data line DL1 is substantially equal to a distance between the line MDL and the second data line DL2.

More specifically, in one embodiment, the shapes and/or the structures of the selecting switch TS1, the block switch TB1, and the display unit DS1 are symmetric to the shapes and/or the structures of the selecting switch TS3, the block switch TB3, and the display unit DS3 with respect to the line MDL, substantially. In one embodiment, the pixel units PX2, PX4 can also substantially symmetric to each other, and the symmetric relationship therebetween can be identical to or similar to the symmetric relationship between the pixel units PX1, PX3, and details in this regard will not be repeated herein.

In one embodiment, the first data line DL1 and the second data line DL2 are substantially disposed between the pixel units PX1, PX3. In one embodiment, the first data line DL1 and the second data line DL2 are substantially disposed between the pixel units PX2, PX4. In other words, the pixel units PX1, PX2 are substantially disposed at first sides (e.g., the left sides) of the first data line DL1 and the second data line DL2, and the pixel units PX3, PX4 are substantially disposed at second sides (e.g., the right sides) of the first data line DL1 and the second data line DL2 opposite to the first sides.

Figure 9:
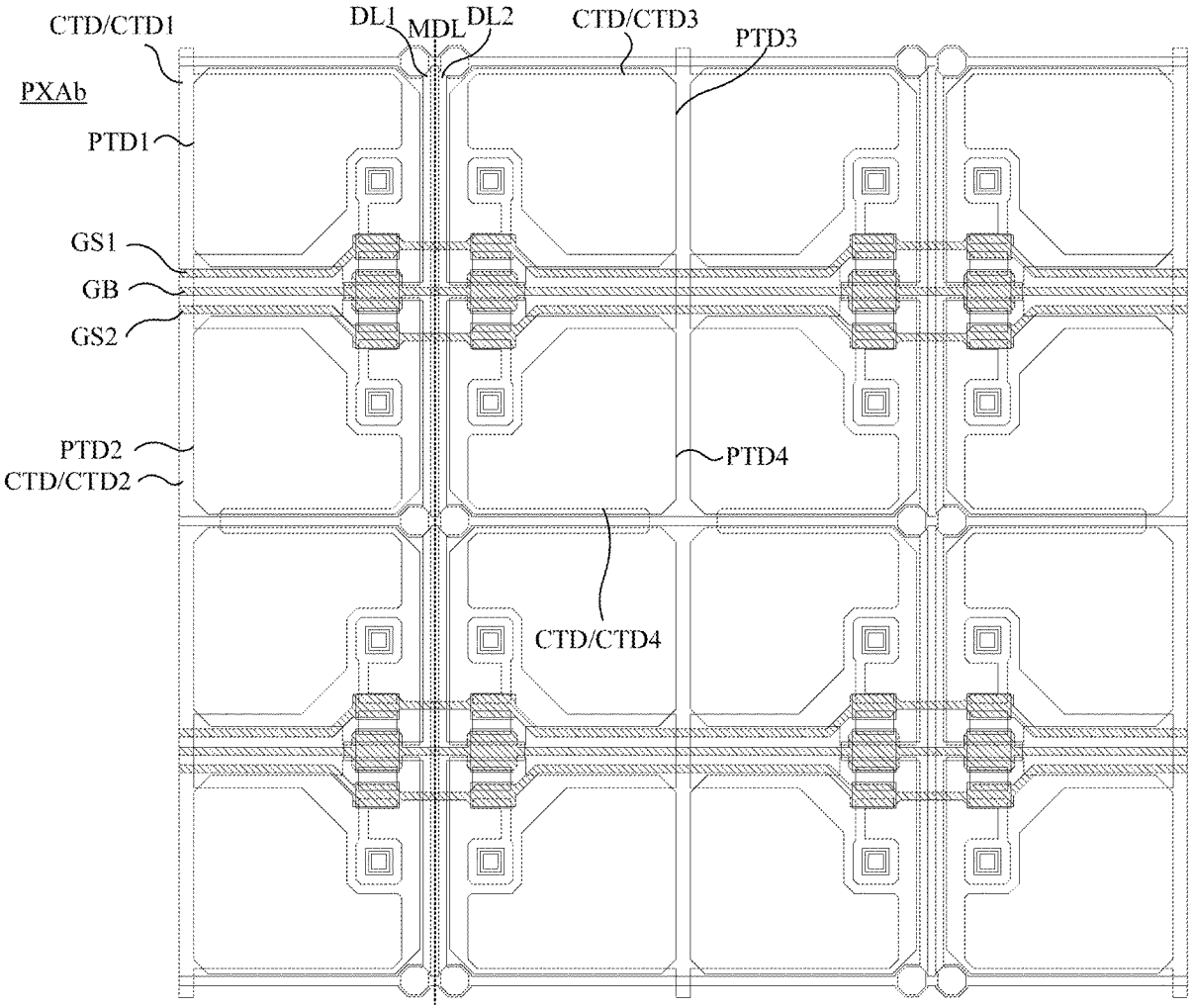
FIG. 9 illustrates a layout of a pixel array according to another embodiment of the present disclosure.

Reference is made to FIG. 9, in which FIG. 9 illustrates a layout of a pixel array PXAb according to another embodiment of the present disclosure. The pixel array PXAb illustrated in FIG. 9 is substantially similar to the pixel array PXA illustrated in FIG. 4, and many aspects that are similar will not be repeated herein.

In this embodiment, the electrode patterns of the pixel electrode PTD1 and the pixel electrode PTD2 of the pixel units PX1, PX2 are respectively symmetric to electrode patterns of the pixel electrode PTD3 and the pixel electrode PTD4 of the pixel units PX3, PX4 with respect to the line MDL, substantially. In this embodiment, the electrode patterns of the first portion CTD1 and the second portion CTD2 of the common electrode CTD corresponding to the pixel electrode PTD1 and the pixel electrode PTD2 are symmetric with the electrode patterns of the third portion CTD3 and the fourth portion CTD4 of the common electrode CTD corresponding to the pixel electrode PTD3 and the pixel electrode PTD4 respect to the line MDL.

In this embodiment, the pixel electrode PTD1 and the pixel electrode PTD2 are substantially disposed at first sides (e.g., the left sides) of the first data line DL1 and the second data line DL2, and the pixel electrode PTD3 and the pixel electrode PTD4 are substantially disposed at second sides (e.g., the right sides) of the first data line DL1 and the second data line DL2 opposite to the first sides. In this embodiment, the first portion CTD1 and the second portion CTD2 of the common electrode CTD are substantially disposed at first sides (e.g., the left sides) of the first data line DL1 and the second data line DL2, and the third portion CTD3 and the fourth portion CTD4 of the common electrode CTD are substantially disposed at second sides (e.g., the right sides) of the first data line DL1 and the second data line DL2 opposite to the first sides.

Although the present disclosure has been described in considerable detail with reference to certain embodiments thereof, other embodiments are possible. Therefore, the scope of the appended claims should not be limited to the description of the embodiments contained herein.

What is claimed is:

1. A display device comprising:

a first display unit comprising a first pixel electrode;

a first selecting switch electrically connected to the first pixel electrode;

a first block switch electrically connected to the first selecting switch and the first pixel electrode;

a first selecting gate line configured to provide a first selecting gate signal to a control end of the first selecting switch to turn on or turn off the first selecting switch;

a second display unit comprising a second pixel electrode adjacent to the first pixel electrode;

a second selecting switch electrically connected to the second pixel electrode;

a second block switch electrically connected to the second selecting switch and the second pixel electrode;

a second selecting gate line configured to provide a second selecting gate signal to a control end of the second selecting switch to turn on or turn off the second selecting switch, wherein when the first selecting switch turns on, the second selecting switch turns off, and when the second selecting switch turns on, the first selecting switch turns off; and a block gate line configured to provide a block gate signal to a control end of the first block switch and a control end of the second block switch to concurrently turn on or turn off the first block switch and the second block switch.

2. The display device as claimed in claim 1, wherein an electrode pattern of the first pixel electrode and an electrode pattern of the second pixel electrode are symmetric to each other with respect to the block gate line, substantially.

3. The display device as claimed in claim 1, wherein the first pixel electrode and the second pixel electrode are substantially disposed at two opposite sides of the first selecting gate line, the second selecting gate line, and/or the block gate line.

4. The display device as claimed in claim 1 further comprising:

a third pixel electrode adjacent to the first pixel electrode;

a third selecting switch electrically connected to the third pixel electrode, wherein a control end of the third selecting switch is configured to receive the first selecting gate signal from the first selecting gate line, so as to make the first selecting switch and the third selecting switch turn on or turn off concurrently; and a third block switch electrically connected to the third selecting switch and the third pixel electrode, wherein a control end of the third block switch is configured to receive the block gate signal from the block gate line, so as to make the first block switch, the second block switch, and the third block switch turn on or turn off concurrently;

wherein an electrode pattern of the first pixel electrode and an electrode pattern of the third pixel electrode are substantially symmetric to each other.

5. The display device as claimed in claim 4 further comprising:

a first data line configured to provide a first data voltage to the first pixel electrode; and a second data line configured to provide a second data voltage to the third pixel electrode;

wherein the first pixel electrode and the third pixel electrode are substantially disposed between the first data line and the second data line.

6. An electronic paper display device comprising:

an electronic ink layer;

a common electrode disposed at a first side of the electronic ink layer;

a first pixel electrode disposed at a second side of the electronic ink layer;

a first selecting switch electrically connected to the first pixel electrode;

a first block switch electrically connected to the first selecting switch and the first pixel electrode;

a first selecting gate line configured to provide a first selecting gate signal to a control end of the first selecting switch to turn on or turn off the first selecting switch;

a second pixel electrode adjacent to the first pixel electrode and disposed at the second side of the electronic ink layer;

a second selecting switch electrically connected to the second pixel electrode;

a second block switch electrically connected to the second selecting switch and the second pixel electrode;

a second selecting gate line configured to provide a second selecting gate signal to a control end of the second selecting switch; and a block gate line configured to provide a block gate signal to a control end of the first block switch and a control end of the second block switch to concurrently turn on or turn off the first block switch and the second block switch.

7. The electronic paper display device as claimed in claim 6, wherein an electrode pattern of the first pixel electrode and an electrode pattern of the second pixel electrode are symmetric to each other with respect to the block gate line, substantially.

8. The electronic paper display device as claimed in claim 6, wherein the common electrode comprises:

a first portion corresponding to the first pixel electrode; and a second portion corresponding to the second pixel electrode;

wherein an electrode pattern of the first portion of the common electrode and an electrode pattern of the second portion of the common electrode are symmetric to each other with respect to the block gate line, substantially.

9. The electronic paper display device as claimed in claim 6, wherein the first pixel electrode and the second pixel electrode are substantially disposed at two opposite sides of the first selecting gate line, the second selecting gate line, and/or the block gate line.

10. The electronic paper display device as claimed in claim 6 further comprising:

a third pixel electrode adjacent to the first pixel electrode;

a third selecting switch electrically connected to the third pixel electrode, wherein a control end of the third selecting switch is configured to receive the first selecting gate signal from the first selecting gate line, so as to make the first selecting switch and the third selecting switch turn on or turn off concurrently; and a third block switch electrically connected to the third selecting switch and the third pixel electrode, wherein a control end of the third block switch is configured to receive the block gate signal from the block gate line, so as to make the first block switch, the second block switch, and the third block switch turn on or turn off concurrently;

wherein an electrode pattern of the first pixel electrode and an electrode pattern of the third pixel electrode are substantially symmetric to each other.

* * * * *